US006594858B1

(12) United States Patent
Kremer

(10) Patent No.: US 6,594,858 B1
(45) Date of Patent: Jul. 22, 2003

(54) COUPLING DEVICE FOR JOINING A DOOR STOP TO THE HINGE OF DOOR OF A MOTOR VEHICLE

(75) Inventor: Johannes Kremer, Remscheid (DE)

(73) Assignee: Ed. Scharwaechter GmbH, Remscheid (DE)

( * ) Notice: Subject to any disclaimer, the term of this patent is extended or adjusted under 35 U.S.C. 154(b) by 0 days.

(21) Appl. No.: 09/762,420

(22) PCT Filed: Aug. 5, 1999

(86) PCT No.: PCT/DE99/02462

§ 371 (c)(1),
(2), (4) Date: Feb. 6, 2001

(87) PCT Pub. No.: WO00/08284

PCT Pub. Date: Feb. 17, 2000

(30) Foreign Application Priority Data

Aug. 6, 1998 (DE) ..... 198 35 572

(51) Int. Cl.[7] ..... E05D 11/10

(52) U.S. Cl. ..... 16/332; 16/342; 16/82; 296/146.11

(58) Field of Search ..... 16/332, 86 C, 16/366, 334, 342, 82; 296/146.11, 146.12; 464/137, 149

(56) References Cited

U.S. PATENT DOCUMENTS

| | | | | |
|---|---|---|---|---|
| 365,413 A | * | 6/1887 | Stuart | |
| 1,742,699 A | * | 1/1930 | Fellows | |
| 2,643,529 A | * | 6/1953 | Thomas | |
| 2,743,592 A | * | 5/1956 | Nagy | |
| 3,905,065 A | * | 9/1975 | Seeger et al. | |
| 4,494,273 A | * | 1/1985 | Straus | |
| 4,628,567 A | * | 12/1986 | Brockhaus et al. | 16/267 |
| 5,104,161 A | * | 4/1992 | Kautt | 292/157 |
| 5,173,993 A | * | 12/1992 | Baker | 16/329 |
| 5,761,769 A | | 6/1998 | Brueckner et al. | 16/342 |
| 6,349,449 B1 | * | 2/2002 | Kuehl | 16/342 |

FOREIGN PATENT DOCUMENTS

| | | | |
|---|---|---|---|
| DE | 29600661 | 6/1997 | E05D/11/08 |
| DE | 29814134 U1 * | 1/2000 | |
| FR | 2660008 A1 * | 9/1991 | |
| GB | 1391095 | 4/1975 | E05D/7/086 |

* cited by examiner

*Primary Examiner*—Anthony Knight
*Assistant Examiner*—Alison K. Pickard
(74) *Attorney, Agent, or Firm*—Davidson, Davidson & Kappel, LLC

(57) ABSTRACT

The invention relates to a coupling device for joining a door stop (17) to the hinge (1, 2) of a door of a motor vehicle, especially a door stop (17) consisting of a brake element and a retaining element that is rotationally fixed to one half (1) of the hinge and a retaining housing (18) that is rotationally fixed to the other half (2) of the hinge, whereby the brake element and retaining element is formed by an engaging element with an external peripheral contour that deviates from a pure circular shape and the retaining housing (18) is formed by a hollow profiled section with at least one inner peripheral contour that marks at least one braking or retaining position. The aim of the invention is to provide a coupling device that simplifies the production of and enables the production cost of the semi-hinge and the retaining housing to be reduced, in addition to facilitating assembly of the door stop with one half of the hinge of the door of a motor vehicle. This is achieved by rotationally fixing at least the retaining housing (18) of the door stop (17) to the appropriate part of the hinge (2) by means of a connecting element (20) that is made from a material that can be elastically deformed to a limited extent under pressure and which is provided on both sides with means enabling a positive fit with complementary counter-forms on the eye of the hinge (16) and the retaining housing (18).

10 Claims, 3 Drawing Sheets

COUPLING DEVICE FOR JOINING A DOOR STOP TO THE HINGE OF DOOR OF A MOTOR VEHICLE

BACKGROUND OF THE INVENTION

The present invention relates to a connecting device of for connecting a door stop to a vehicle door hinge, in particular a door stop which comprises a braking and retaining body connected directly or indirectly in a rotationally secure manner to the one hinge half and a holder housing connected in a rotationally secure manner to the other hinge half, and whose braking and retaining body is formed by an engagement body having an outer circumferential contour deviating from the pure circular shape and whose holder housing is formed by a hollow profile section having, for its part, an inner circumferential contour marking at least one braking or retaining position.

A motor-vehicle door hinge which is equipped with a door stop is known in practice, the said hinge being distinguished, on the one hand, by the capability of applying very high braking and retaining forces and, on the other hand, by requiring, by comparison, an extremely small amount of installation space and also by a very small number of components. However, these advantages are offset by the disadvantage that if a door stop of this type is integrated into the hinge, a considerable outlay is required for the precise machining of those regions of the gudgeon which form the holder housing, which machining is required in order to produce braking and retaining ramps, and under some circumstances, at least in the case of hinge halves formed from sections of a continuous hinge profile, the entire hinge half has to be produced from an expensive material, possibly even simultaneously accompanied by less good weldability, resulting in a relatively costly fastening of the hinge to the door assembly parts. Furthermore, the extended design of the one hinge half, required for the accommodation of the holder housing, also results in an undesirable increase in the weight of the hinge as a whole.

The proposal for reducing the high outlay on material and machining required in the case of a design of the door stop integrated in the hinge by designing at least the holder housing of the door stop as an independent component and connecting it as such to the gudgeon of the one hinge half, is known in practice. Although this achieves the advantage of making it possible for the hinge half to be designed more simply and for it to be produced from a less expensive material and with a smaller outlay on machining, and also achieves the advantage of being able to produce the holder housing from a continuous profiled material in a separate production operation, even this embodiment of a vehicle door hinge equipped with a connected door stop still requires a considerable outlay on machining for the mutual, positive engagements required for the rotationally secure fixing of the holder housing to the gudgeon of the one hinge half. This is particularly relevant because even a small amount of play between the mutually and positively engaged regions, on the one hand, of the holder housing and, on the other hand, of the gudgeon lead, during operation of the door stop, to mutual relative movements of the two parts and therefore initially to a shifting of the door-retaining points and subsequently to a deflection of the mutual engagement surfaces and therefore to production of noise.

SUMMARY OF THE INVENTION

It is the object of the invention to provide a connecting device, which incurs a low outlay on production for itself, allows the production of the hinge half and holder housing to be made less expensive and, at the same time, for the fitting together of a door stop to the one hinge half of a vehicle door hinge to be simplified.

The object may be achieved according to the present invention in that at least the holder housing of the door stop is connected in a rotationally secure manner to the associated part of the hinge by means of a connecting element which comprises a material which can be deformed elastically to a limited extent under pressure and is equipped on both sides with means for positive engagement with complementarily designed mating forms on the gudgeon, on the one hand, and on the holder housing, on the other hand.

In this connection, suitable materials for realizing the annular connecting element are all those which, on the one hand, can be sufficiently deformed elastically in order to compensate for manufacturing tolerances, which exist under the action of a sufficient pressure during the assembly or fitting of the door stop or holder housing and hinge half, in particular gudgeon, at the mutually facing end sides of both parts, but, on the other hand, at the same time also have sufficient strength for the transmission even of high torques. The use of a connecting element of this type in the fitting of a door stop to the vehicle door hinge makes it possible, as a consequence of its tolerance-compensating action, for the manufacture both of the hinge half and the holder housing to be considerably less expensive because of the omission of costly machining or finishing of mutually interacting surfaces. At the same time, the tolerance-compensating action of the connecting element naturally also simplifies the fitting of the door stop to the hinge half. Thus, while incurring a low outlay on production for itself, a door stop which can be premanufactured as an independent component, at least with regard to its holder housing, and can be connected to a door hinge, enables the production of the hinge half and holder housing to be made less expensive and, at the same time, the fitting of a door stop to the one hinge half of a vehicle door hinge to be simplified.

The connecting element forming a connecting device can generally be used with particular advantage in door stops of the type in which the holder housing can be connected to the corresponding hinge half in a smooth, axial extension of the gudgeon hole of that hinge half in which the hinge pin is mounted with a running fit. In order to fit the hinge half and holder housing, it is necessary that comparatively high torques between the hinge half and holder housing can also be supported, for which purpose, according to a particularly preferred embodiment, it is provided that the connecting element is formed by an annular body which corresponds, with regard to its clear profile cross section, to the clear profile cross section of the gudgeon of the holder housing, depending on which of these two parts has the larger clear diameter, and is equipped in an alternating manner in the axial direction from its one end side to its other end side with at least one groove recess and a projection.

In this connection, in a further advantageous development it can be provided that the free end surface of the gudgeon of the one hinge half is provided with at least one groove-shaped recess, and on its end side facing the gudgeon the annular body forming the connecting element is equipped with at least one complementarily designed axial projection, and that at its end side facing the gudgeon the holder housing has at least one axial projection which is assigned a complementarily designed groove recess in the annular body.

For the reliable transmission or support also of high torques even when a material of lesser load-bearing capacity is used to form the annular connecting element, it is preferably provided according to a further feature of the invention that on its end side facing the holder housing the annular connecting element has two groove-like recesses offset with respect to each other by 180°, and on its end side facing the gudgeon has two axial projections offset with respect to each other by 180°.

In the interests of production which is as cost-effective as possible, the annular connecting element is expediently formed by an injection-moulded part made of a plastic material, in which case, besides relatively readily formable metals, plastic materials having sufficient strength are particularly suitable as the material for the annular connecting element.

However, depending on the requirements of the individual application, a simplified design, which can be carried out by stamping, of the positively intermeshing means for the rotationally secure fixing of the holder housing or of the annular connecting element to the gudgeon can be provided, in particular to the effect that the means for mutual, positive engagement, which means are formed alternately, on the one hand, on the lower end surface of the gudgeon and on the upper end surface of the holder housing, and, on the other hand, on the two end sides of the annular connecting element, are in each case formed by a multiplicity of preferably axial recesses or depressions of corrugated form. In particular, the means formed alternately on both parts may be designed in each case in the manner of a toothing arrangement.

In a further refinement of the present invention or in an analogous application of the inventive concept, it can further be provided in particular applications that the engagement part forming the braking and retaining body of the door stop is, for its part, in rotationally secure driving connection with the shank part of the hinge pin by means of a coupling element which consists of a material which can be deformed elastically to a limited extent and is in positive engagement with both parts via alternately formed projections and recesses.

BRIEF DESCRIPTION OF THE DRAWINGS

The present invention is explained in greater detail below with reference to the attached drawings and using an exemplary embodiment.

DETAILED DESCRIPTION

Figure 1:
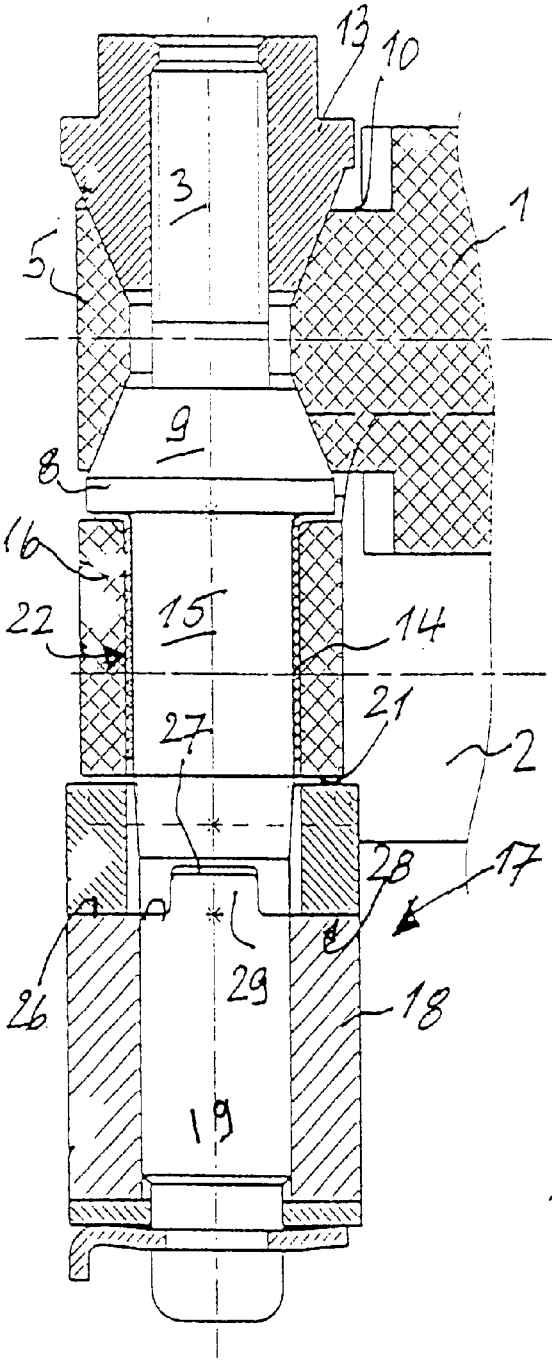
FIG. 1 shows a first longitudinal section through a constructional unit comprising a hinge and a door stop.
Figure 2:
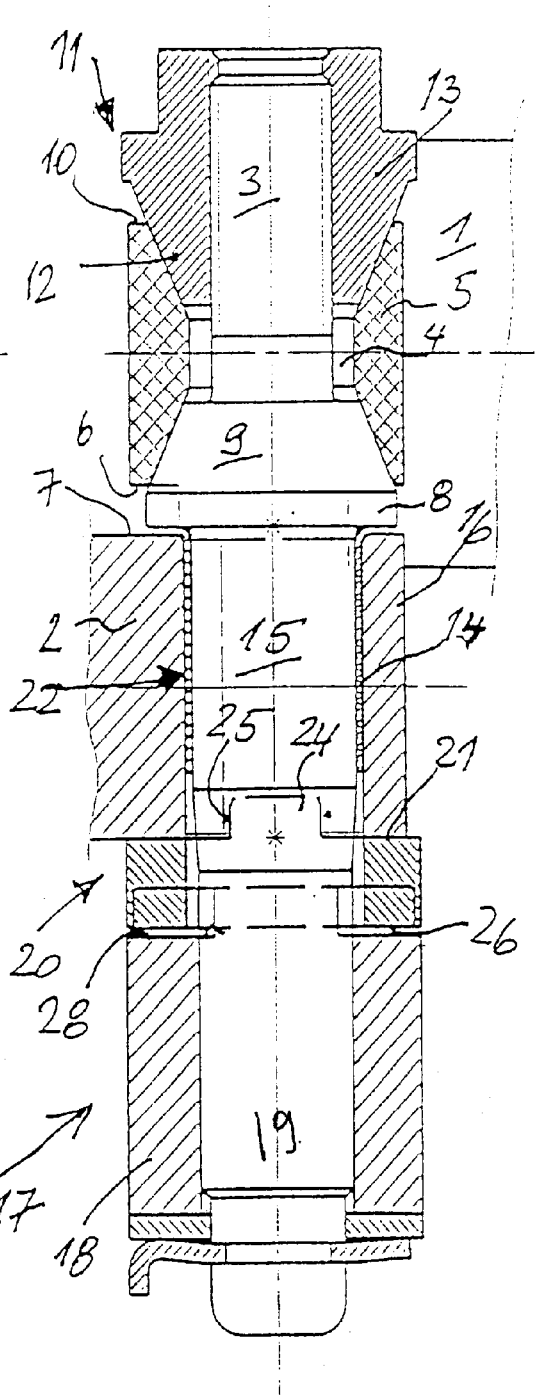
FIG. 2 shows a second longitudinal section through the constructional unit from FIG. 1.
Figure 3:
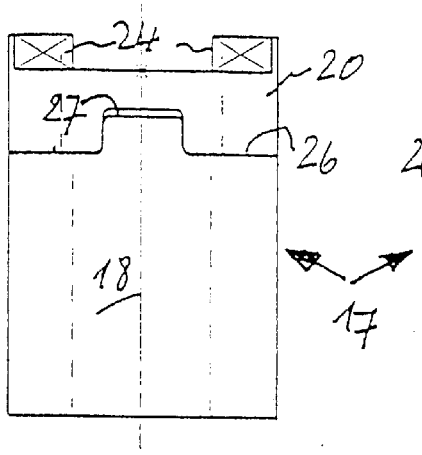
FIG. 3 shows a side view of a holder housing joined to a connecting element.
Figure 4:
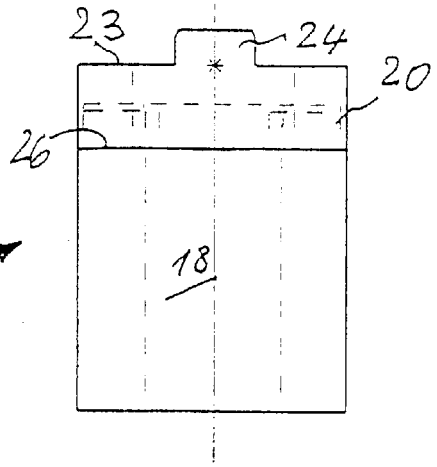
FIG. 4 shows a side view, rotated through 90°, of the holder housing from FIG. 3.

The separable motor-vehicle door hinge illustrated in FIGS. 1 and 2 of the exemplary embodiment comprises a first hinge half 1, which can be fitted to the one of two door assembly parts (not shown in the drawing)—the door or door pillar, and a second hinge half 2, which is to be fitted to the other door assembly part, and also comprises a hinge pin 3 connecting the two hinge halves 1 and 2 pivotably to each other. When the hinge is joined together, the hinge pin 3 is retained in the first hinge half 1 in a rotationally secure manner in the gudgeon 5 by means of radially directed, positively acting means 4; furthermore, the hinge pin 3 has a radially protruding collar 8 which engages between the mutually facing end surfaces 6 and 7 of both hinge halves 1 and 2 and, on its side facing the demountable hinge half 1, forms a cone 9 which tapers towards the end of the hinge pin 3 and is assigned a complementarily designed, correspondingly conical widening in the gudgeon hole 5 of the hinge half 1. The hinge pin 3 is furthermore secured, by means of a screw connection 11 bearing against the outer end surface 10 of the hinge half 1, against automatically lifting out of its gudgeon hole, the means of securing against automatically lifting out being formed by a screw nut 13 which is screwed onto a circumferential thread of the free end of the hinge pin and engages in a conical widening of the gudgeon by means of a conical projection 12.

Figure 8:
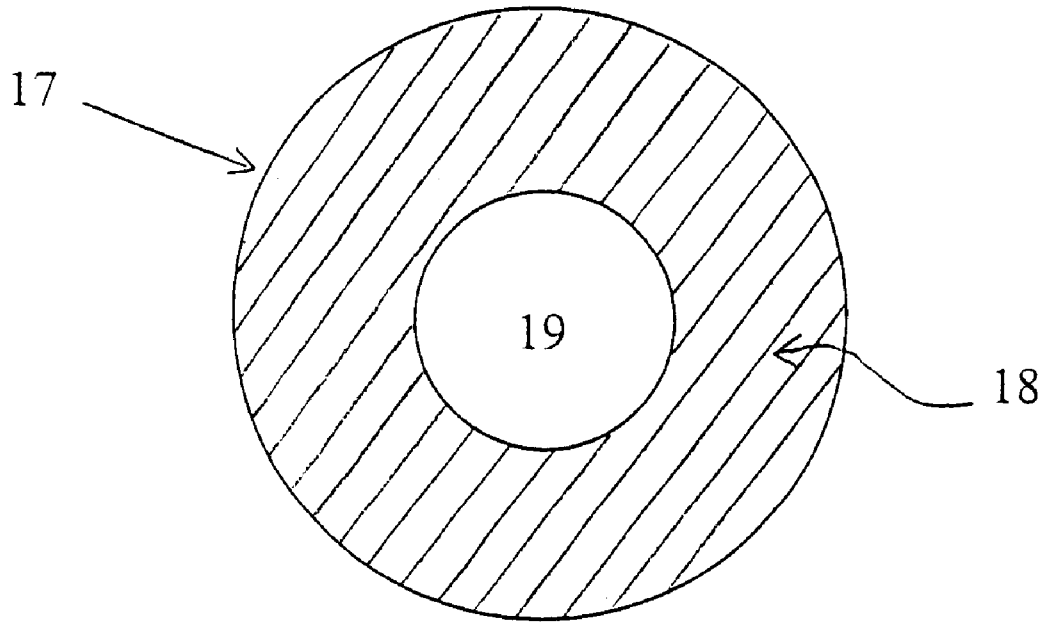
FIG. 8 shows a section view of the door stop along line A—A of FIG. 1.

The hinge pin 3 is mounted in a freely rotatable manner with a running fit via a cylindrical shank part 15 in the hinge half 2 by means of a bearing bushing 14 made of maintenance-free bearing material, for example fibre-reinforced Teflon. Connected to the gudgeon 16 of the other hinge half 2 is a door stop 17 essentially comprising a holder housing 18, formed by a section of profiled material, and an engagement part 19 which is formed as an axial extension of the hinge pin 3 and passes through the holder housing. The engagement part 19 which is connected to the hinge pin 3 has, in a manner known per se, a profile cross-sectional shape (illustrated in more detail in FIG. 8) which deviates from the pure circular shape, and the holder housing 18 has an inner circumferential surface designed in a complementary manner with respect to the hinge pin 3 in order to produce braking and retaining forces as a function of a rotational movement of the other hinge half 2. Thus, the engagement part 19 acts as a braking and retaining body in this embodiment by virtue of its interaction with holder housing 18.

In the embodiment shown, the holder housing 18 is supported on the lower end surface 21 of the gudgeon 16 of the one hinge half 2 in a rotationally secure manner, via positive-locking means, by means of a tolerance-compensating, annular connecting element 20. In the embodiment shown, the annular connecting element 20 consists of an injection-moulded plastic part and has, as can be seen in particular from the illustrations of FIGS. 1 and 2, a clear width corresponding to the clear width of the gudgeon hole 22 in the gudgeon 16.

According to the illustration in FIGS. 3 to 7, on its end surface 23 assigned to the lower end surface 21 of the gudgeon 16, the annular connecting element 20 has two axial projections 24 which are offset with respect to each other by 180° and, with the connecting element 20 fitted or the holder housing 18 fitted, engage positively in correspondingly arranged, axial groove recesses 25 in the lower end surface 21 of the gudgeon 16. On its lower end surface 26 facing the holder housing 18, the annular connecting element 20 has two axial groove recesses 27 which are offset with respect to each other by 180° and in which, with the holder housing 18 fitted, corresponding projecting 29 formed in an axially projecting manner on the end surface 28 of the said connecting element engage.

The means used for mutual positive engagement, which means are formed alternately, on the one hand, on the lower end surface 21 of the gudgeon 16 and on the upper end surface 28 of the holder housing 18, and, on the other hand, on the two end surfaces of the annular connecting element 20 are in each case formed by a multiplicity of preferably axial recesses of corrugated form.

Figure 5:
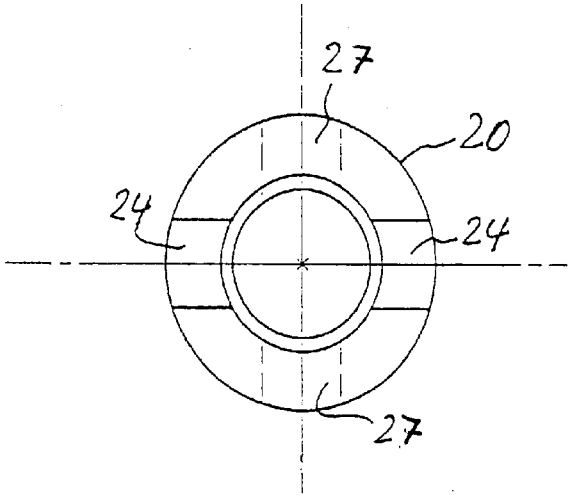
FIG. 5 shows a plan view of the holder housing from FIGS. 3 and 4, which housing is joined to a connecting element.
Figure 6:
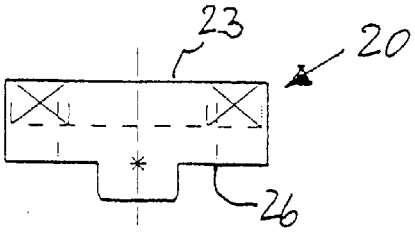
FIG. 6 shows a side view of a connecting element.
Figure 7:
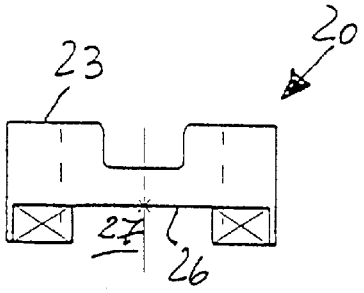
FIG. 7 shows an illustration, rotated through 90°, of the connecting element from FIG. 5.

As can be seen in particular from FIG. 5, the pairs of axial projections 24 and axial groove recesses 27, which pairs are arranged on the annular connection element 20 alternately on its one end side 23 and its other end side 26, are offset with respect to one another in each case by 90°.

What is claimed is:

1. A connecting device for connecting a door stop to a vehicle door hinge, said door stop comprising a braking and retaining body connected in a rotationally secure manner to a first hinge half and a holder housing connected in a rotationally secure manner to a second hinge half, wherein said braking and retaining body is formed by an engagement body having an outer circumferential contour deviating from a pure circular shape, wherein said holder housing is formed by a hollow profile section having an inner circumferential contour marking at least one braking or retaining position, wherein at least the holder housing is connected in a rotationally secure manner to said second hinge half through a connecting element, said connecting element including a material which can be deformed elastically to a limited extent under pressure and includes a first end surface facing a gudgeon of the second hinge half and a second end surface opposite the first end surface facing the holder housing, the first and second end surfaces including means for positive engagement with complementary-designed mating forms on the gudgeon on the one hand and on the holder housing on the other hand.

2. The connecting device according to claim 1, wherein said connecting element is formed by an annular body which corresponds, with regard to a clear profile cross section, to a clear profile cross section of said holder housing, and is equipped in an alternating manner in the axial direction from the first end surface to the second end surface with at least one axial groove recess and at least one axial projection.

3. The connecting device according to claim 1, wherein a free, lower end surface of the gudgeon of the second hinge half is provided with at least one axially directed, groove-shaped recess, and on the first end surface said connecting element has at least one axial projection, wherein said holder housing has at least one axial projection on an end surface facing the gudgeon which is assigned a complementarily designed groove recess in the connecting element.

4. The connecting device according to claim 1, wherein on the second end surface, housing said annular connecting element has two groove-like recesses offset with respect to each other by 180°, and on the first end surface, said annular connecting element has two axial projections offset with respect to each other by 180°.

5. The connecting device according to claim 1, wherein the annular connecting element is formed by an injection-molded part made of a plastic material.

6. The connecting device according to claim 1, wherein said means for positive engagement are formed alternately, on the one hand, on a lower end surface of the gudgeon and on an upper end surface of the holder housing, and, on the other hand, on the first and second surfaces of the annular connecting element and are in each case formed by a plurality of recesses.

7. The connecting device as recited in claim 6 wherein the plurality of recesses preferably are axial recesses of corrugated form.

8. The connecting device according to claim 1, wherein the engagement body is in rotationally secure driving connection with a shank part of a hinge pin through a coupling element which includes a material which can be deformed elastically to a limited extent and is in positive engagement with both the engagement body and the shank part via alternately formed projections and recesses.

9. A door stop for a vehicle door hinge comprising:

a braking and retaining body connected in a rotationally secure manner to a first hinge half, the braking and retaining body being formed by an engagement body having an outer circumferential contour deviating from a pure circular shape;

a holder housing being formed by a hollow profile section having an inner circumferential contour marking at least one braking or retaining position, and a connecting element connecting the holder housing in a rotationally secure manner to a second hinge half, the connecting element including a material deformable elastically to a limited extent under pressure and including a first end surface facing a gudgeon of the second hinge half and a second end surface opposite the first end surface facing the holder housing, the first and second end surfaces including positive engagement devices for engaging complementary-designed mating forms on both the gudgeon and on the holder housing.

10. A connecting element for coupling a vehicle door hinge to a braking arrangement, wherein said vehicle door hinge includes a first hinge half, a second hinge half, and a hinge pin pivotably connecting the first hinge half to the second hinge half, and wherein said braking arrangement includes a holder housing formed by a hollow profile section, the holder housing having an inner circumferential contour marking at least one retaining position, and an engagement part engaging the holder housing being rotatably connected with said hinge pin, the connecting element comprising:

a first end engaging a gudgeon of one of said first hinge half and second hinge half; and a second end engaging said holder housing;

wherein said connecting element holds said holder housing at a distance from said gudgeon.

* * * * *